US006977638B1

(12) United States Patent
Bayot et al.

(10) Patent No.: US 6,977,638 B1
(45) Date of Patent: Dec. 20, 2005

(54) METHOD FOR COMPENSATING PERTURBATIONS CAUSED BY DEMULTIPLEXING AN ANALOG SIGNAL IN A MATRIX DISPLAY

(75) Inventors: Jean-Marc Bayot, La Buisse (FR); Hugues Lebrun, Coublevie (FR)

(73) Assignee: Thales Avionics LCD S.A., Paris (FR)

( * ) Notice: Subject to any disclaimer, the term of this patent is extended or adjusted under 35 U.S.C. 154(b) by 514 days.

(21) Appl. No.: 10/148,556

(22) PCT Filed: Nov. 27, 2000

(86) PCT No.: PCT/FR00/03307

§ 371 (c)(1),
(2), (4) Date: May 30, 2002

(87) PCT Pub. No.: WO01/41112

PCT Pub. Date: Jun. 7, 2001

(30) Foreign Application Priority Data

Nov. 30, 1999 (FR) ..... 99 15084

(51) Int. Cl.[7] ..... G09G 3/36

(52) U.S. Cl. ..... 345/94; 345/98
(58) Field of Search ..... 345/94–96, 98–100

(56) References Cited

U.S. PATENT DOCUMENTS 5,252,956 A * 10/1993 Senn et al. ..... 345/100
5,384,496 A * 1/1995 Tanaka ..... 327/94
5,896,117 A * 4/1999 Moon ..... 345/95

FOREIGN PATENT DOCUMENTS

EP 275 140 A2 7/1988 ..... G09G 3/36
EP 622 772 A1 11/1994 ..... G09G 3/36
EP 984 424 A1 3/2000 ..... G09G 3/36

* cited by examiner

*Primary Examiner*—Alexander Eisen
(74) *Attorney, Agent, or Firm*—Oblon, Spivak, McClelland, Maier & Neustadt, P.C.

(57) ABSTRACT

The present invention relates to a method of compensating for the disturbances due to the demultiplexing of an analogue signal with regard to a circuit comprising N data lines, wherein the demultiplexing is carried out by sample-and-hold circuits whose input receives the analogue signal and whose output is connected to one of the N data lines, the N sample-and-hold circuits being operated in succession by a sampling signal (ECHi).

During the application of the sampling signal (ECHi, V1) to one of the sample-and-hold circuits, an opposite compensation level (V3) which is lower than the level of the sampling signal is applied to the N–1 sample-and-hold circuits.

Application in particular to LCD screens.

8 Claims, 3 Drawing Sheets

METHOD FOR COMPENSATING PERTURBATIONS CAUSED BY DEMULTIPLEXING AN ANALOG SIGNAL IN A MATRIX DISPLAY

This application claims the benefit under 35 U.S.C. § 365 of International Application PCT/FR00/03307, filed Nov. 27, 2000, which claims the benefit of French Application No. 9915084, filed Nov. 30, 1999.

BACKGROUND OF THE INVENTION

The present invention relates to a method of compensating for the disturbances due to the demultiplexing of an analogue signal with regard to a circuit comprising N data lines, more especially with regard to a matrix display. The present invention will be described while referring to a matrix display such as an LCD screen standing for "Liquid Crystal Display", more especially an LCD screen of the active matrix type. However, it is obvious to the person skilled in the art that the present invention can be applied to other types of matrix displays, in particular to LED screens standing for "Light Emitted Diodes", to OLED screens or "Organic Light Emitted Diodes" or to matrix displays of the same type in which the image points are capacitive elements.

DESCRIPTION OF PRIOR ART

As represented in FIG. 1, in a known manner, a matrix display is generally composed of a first substrate comprising selection lines referenced hereafter rows L1, L2, L3 . . . L0 and data lines referenced hereafter columns C1, C2, C3, C4, C5 . . . CN, at the intersections of which are situated image points symbolized by the capacitance 2 in FIG. 1. In the case of a matrix display consisting of a liquid crystal screen, the screen comprises a second substrate comprising a back-electrode, the liquid crystals being inserted between the two substrates. In this case, the image points consist in particular of pixel electrodes connected across switching circuits such as transistors or diodes to the selection lines or rows L1 to L0 and to the data lines or columns C1 to CN. The rows and the columns are respectively connected to peripheral control circuits generally referred to as "drivers". The row drivers scan the rows L1 to L0 one after the other and close the switching circuits, that is to say turn on the transistors or the diodes of each row. Moreover, the column drivers apply a cue to each column, namely they charge the electrodes of the selected pixels and modify the optical properties of the liquid crystal lying between these electrodes and the back-electrode thus allowing the formation of images on the screen. When the LCD screen exhibits considerable definition, that is to say a considerable number of rows and columns, the principle of multiplexing between the outputs of the column drivers and the columns of the screen is used in such a way as to reduce the number of tracks at the input of the screen. Thus, as represented in FIG. 1, the columns are grouped into P blocks 1 of N columns, namely five columns C1 to C5 in the embodiment represented. Each block 1 comprises M sample-and-hold circuits 3 consisting, in the embodiment represented, of transistors 3, more especially of FET transistors. Thus, block 1 therefore consists of five FET transistors 3, one of whose electrodes, namely the source s is linked to one of the columns C1, C2, C3, C4, C5 respectively and whose other electrode, namely the drain d, is connected to the same electrode of the other transistors of the block, all the drains being connected to an analogue or video input referenced SA1 for the first block, SA2 for the second block, SAP for the last block, in the case of an LCD screen comprising N columns with N=5×P. Moreover, as represented in FIG. 1, the gates g of the transistors 3 each receive a sampling signal referenced $ECH_1$, $ECH_2$, $ECH_3$, $ECH_4$, $ECH_5$ respectively. Obviously, each block 1 exhibits the same structure.

As represented in FIG. 1, in this case the column driver is a demultiplexer of P analogue or video sources to P×M=N data lines or columns of the matrix screen. The analogue signal is therefore connected to the M drains of the FET transistors of a block and the gates g of the FET transistors 3 are driven by the sampling signal. In a known manner and as represented in FIG. 2, the sampling signals consist of pulsed signals exhibiting two active levels, namely a low level V2 in which the FET transistor 3 is off and a high level V1 in which the FET transistor 3 is on. The sampling signals are applied successively to the gates of the FET transistors 3 of one and the same block, as represented by $ECH_1$, $ECH_2$, $ECH_3$, $ECH_4$ and $ECH_5$.

When a sampling pulse ECHi is applied to the gate g of one of the FET transistors 3 forming the sample-and-hold circuit, disturbances are observed on the analogue signal SA1, SA2 . . . applied to the drain of the transistors of each block. This disturbance is represented by the two spikes I1 and I2 in FIG. 3. Part of the disturbances is due to the parasitic gate/drain capacitance symbolized by Cp of FIG. 1. Owing to this parasitic capacitance, strong capacitive coupling such as represented by the spike I1 is observed when switching the signal on the gate, causing the signal to go from the low level V2 to the high level V1. Subsequently, the input signal converges to its nominal level and then, when the signal goes from the high level V1 to the low level V2, an inverse capacitive coupling is observed, giving the spike 12 in the input signal. Then, the input signal converges to its nominal level. However, the convergence is not always perfect, in particular when the convergence time is insufficient, as symbolized by the dashed line L. In this case, poor quality of the image is obtained. In particular, differences in contrast are observed as is a flicker varying from one column to another and also horizontal "crosstalk".

In fact, part of the disturbance of the video signal during the application of a sampling pulse ECHi corresponds to the inrush of current into the parasitic capacitance Cp of the FET transistor forming a sample-and-hold circuit. The coupling between the gate and the drain of the P×M FET transistors therefore limits the convergence of the analogue source (video) and, consequently, the performance of the LCD screen.

SUMMARY OF THE INVENTION

The aim of the present invention is therefore to propose a method which makes it possible to improve the convergence of the P analogue signals applied to the input of the demultiplexer by compensating for the gate/drain coupling in the FET transistors forming the same-and-hold circuit. Consequently, the subject of the present invention is a method of compensating for the disturbances due to the demultiplexing of an analogue signal with regard to a circuit comprising N data lines, wherein the demultiplexing is carried out by sample-and-hole circuits whose input receives the analogue signal and whose output is connected to one of the N data lines, the sample-and-hold circuit being operated in succession by a sampling signal, characterized in that, during the application of the sampling signal to one of the sample-and-hold circuits, an opposite compensation level which is lower than the level of the sampling signal is applied to the other sample-and-hold circuits.

Preferably, the sampling signal is a signal comprising three levels, namely a first level V1 turning on the sample-and-hold circuit and a second V2 and third V3 levels keeping the sample-and-hold circuits off. Preferably, the three levels of the sampling signal are chosen such that (V2−V3)= (V1−V2)/(N−1).

According to another characteristic of the present invention, in order to eliminate any capacitive coupling, the transition time for going from the second level V2 to the first level V1 and from the second level V2 to the third level V3 are identical. The same holds when going from the first level V1 to the second level V2 and from the third level V3 to the second level V2.

BRIEF DESCRIPTION OF THE DRAWINGS

Other characteristics and advantages of the present invention will become apparent on reading the detailed description given hereinbelow of a preferred embodiment, this description being given with reference to the hereto appended drawings in which.

DESCRIPTION OF A PREFERRED EMBODIMENT

Figure 1:
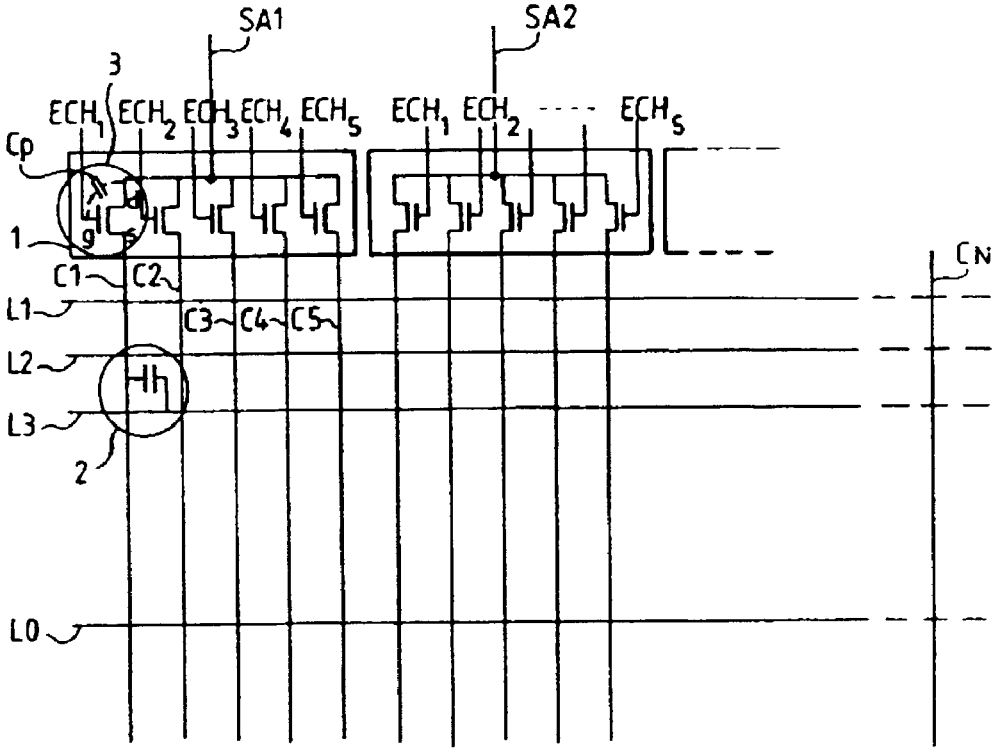
FIG. 1 already described is a diagrammatic representation of an LCD screen connected to a column driver consisting of a demultiplexer allowing the implementation of the present invention.
Figure 4:
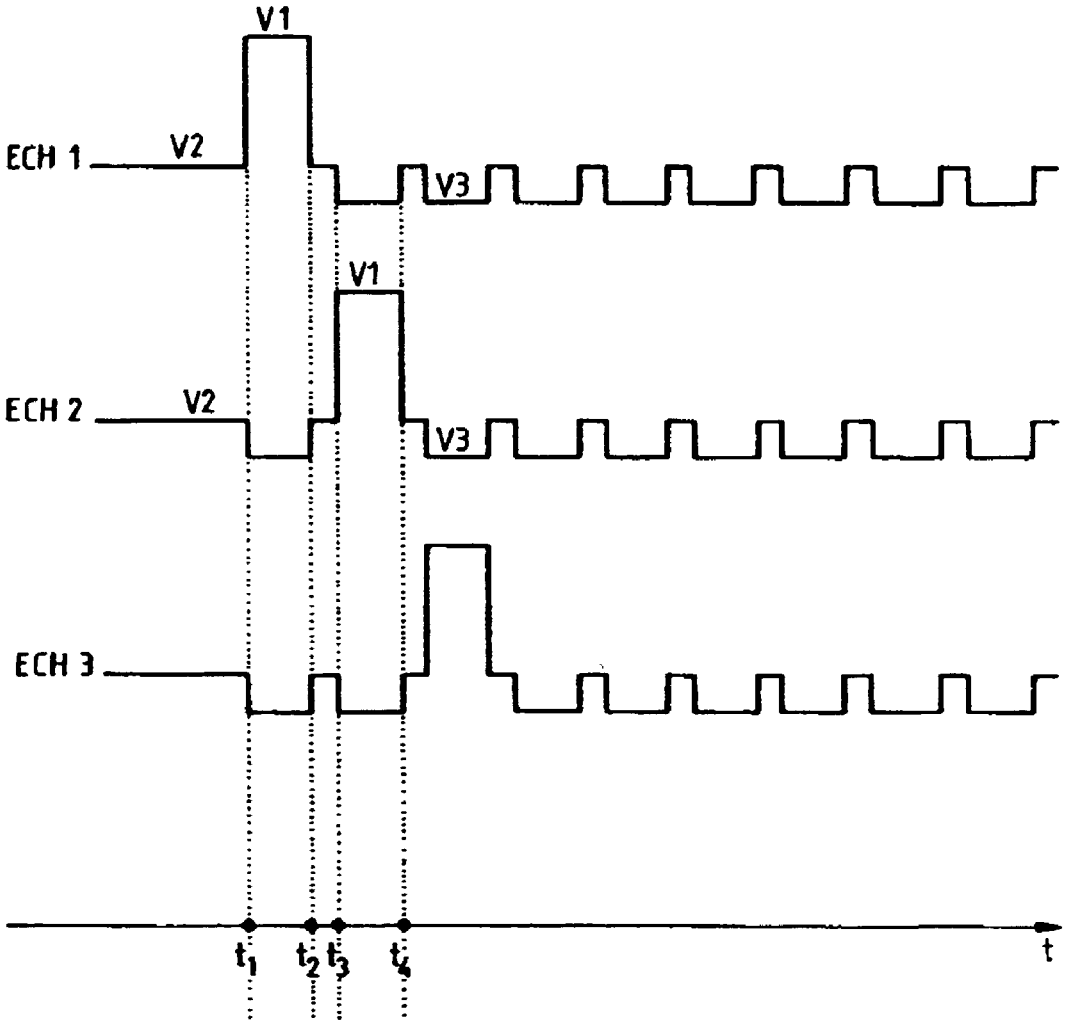
FIG. 4 represents the waveforms of the sampling signals applied to the column driver consisting of a demultiplexer of FIG. 1 according to one embodiment of the present invention.

The present invention will be described while referring to a display of the matrix type such as described hereinabove with reference to FIG. 1. The column driver therefore consists of P blocks 1 each comprising five FET transistors 3 intended for sampling the P video signals SA1, SA2, . . . SAP. The method in accordance with the present invention described hereinbelow makes it possible to improve the convergence of the P video signals applied as input to the column driver by compensating for the gate g/drain d coupling of the FET transistors 3. This is achieved by reducing the quantity of current which the analogue source, namely the video source, has to provide. Thus, as represented in FIG. 4, to obtain this result, in accordance with the present invention, sampling signals ECHi having three levels are used to control the gate g of the five FET transistors of a block. More precisely, the sampling signals ECHi comprise a high level V1 turning the FET transistor on, a first turn-off level V2 in which the FET transistor is off and a second turn-off level V3 below the first turn-off level, in which the FET transistor is off. Thus, as represented in FIG. 4, when the first FET transistor of a block receives the sampling signal, its gate g receives at the time t1 a pulsed signal going from the low level V2 to the high level V1 turning on the FET transistor. At the same moment t1, the gates of the other four FET transistors of the same block receive a pulsed signal going from the turn-off level V2 to a lower turn-off level V3. Then at the time t2, the sampling signal ECH1 applied to the gate of the first FET transistor goes back from the high level V1 to the low level V2; at the same moment t2, the gate of the other four FET transistors goes back from the low level V3 to the turn-off level V2. Subsequently at the time t3, the second transistor of a block is sampled by receiving a pulse, going from the low level V2 to the high level V1, while the gates of the other four transistors receive an inverse pulse going from the low level V2 to the lower level V3, as represented in FIG. 4. By using sampling signals having three levels, the current entering the gate/drain capacitance Cp of the FET transistor selected when switching its gate between the turn-off level V2 and the turn-on level V1 is compensated by the current in the gate/drain capacitances Cp of the other N−1 transistors which switch intentionally from the turn-off level V2 to a lower turn-off level V3. Hence, the voltage variation on the drains of the FET transistors is smaller and the convergence faster.

To obtain optimal convergence, the levels of the sampling signal are chosen so that (V2−V3)=(V1−V2)/(N−1), N being the number of pathways of the demultiplexer. Moreover, the minimization of the disturbances is achieved by optimizing the edge of the pulsed signals when going from the low level V2 to the high level V1 and from the low level V2 to the lower level V3, as will be explained hereinbelow with reference to FIG. 5.

Figure 5:
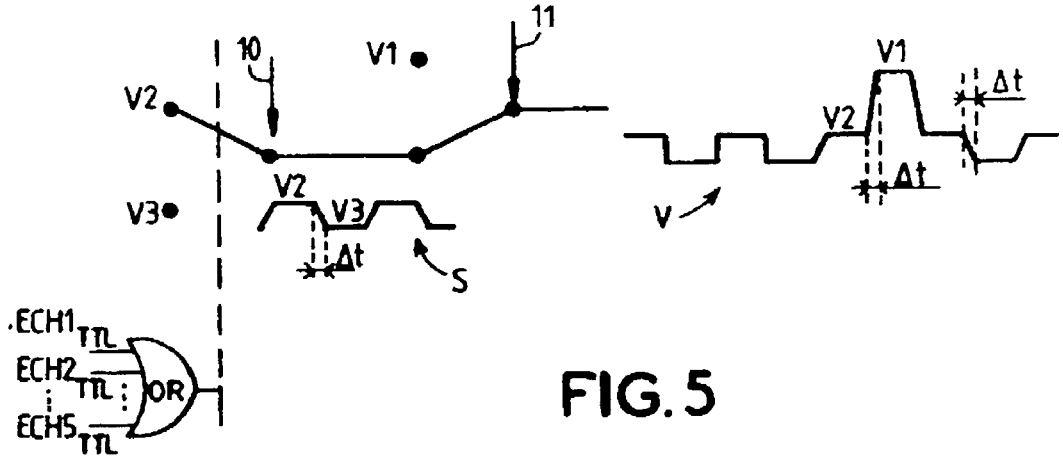
FIG. 5 is a diagrammatic representation of a circuit making it possible to obtain the sampling signals of FIG. 4.
Figure 2:
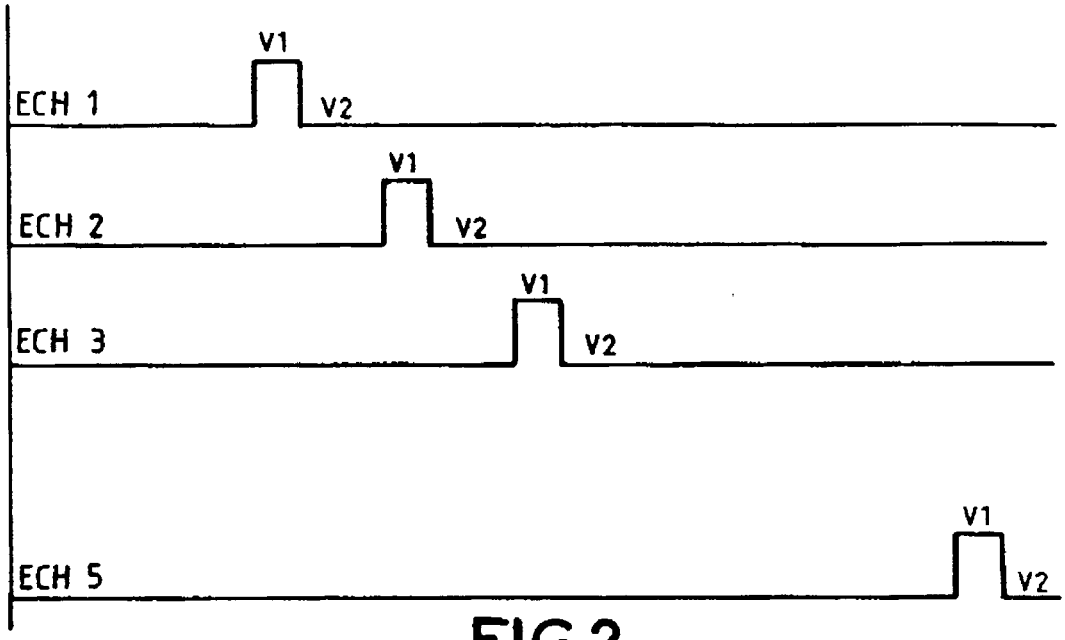
FIG. 2 represents the waveforms of the sampling signal applied to the screen of FIG. 1 according to the prior art.
Figure 3:
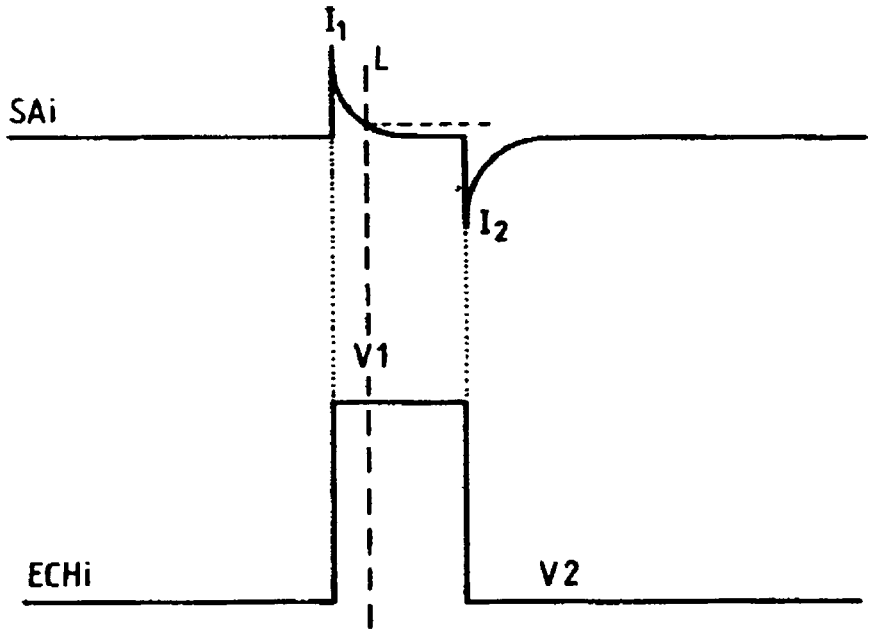
FIG. 3 represents the waveforms of a sampling signal and of the associated analogue input signal showing the disturbances observed during sampling.

Represented very diagrammatically in FIG. 5 is a circuit making it possible to obtain a sampling signal in accordance with the present invention. This circuit consists of a first switching means 10 controlled by the sampling signals ECH1TTL, ECH2TTL . . . passing through an OR gate and making it possible to switch from a low level V2 to a level V3 in such a way as to obtain the signal S. This signal S is sent to an input terminal of a second switching means 11 making it possible to switch between the signal S and a high level V1. The signal V represented in FIG. 5 is therefore obtained at the output of the switching means 11. The switching means 11 switches to the high level V1 only at the moment of the sampling of an FET transistor 3. As represented by the signal V, the switch from the first turn-off level V2 to the turn-on level V1 is effected in a time ΔT. Likewise, the switch from the low level V2 to the lower level V3 is also effected in a time ΔT, as represented on the signal S. Optimizing the duration of the edges makes it possible to minimize the disturbances due to switching from the low level V2 to the high level V1.

The present invention has been described while referring to a matrix display of the active matrix LCD type. However, it is obvious that the present invention can be applied to other types of displays, as was mentioned in the introduction. Furthermore, the present invention can be applied to various types of technology, in particular to screens made from amorphous silicon, low-temperature polycrystalline silicon, high-temperature polycrystalline silicon or crystalline silicon.

What is claimed is:

1. Method of compensating for disturbances due to demultiplexing an analogue signal with regard to a circuit comprising N data lines, N being a positive integer, wherein the demultiplexing is carried out by sample-and-hold circuits whose input receives the analogue signal and whose output is connected to one of the N data lines, the method comprising steps of:

providing a sampling signal comprising a first level V1 configured to turn on the sample-and-hold circuits, a second level V2 configured to keep the sample-and-hold circuits off, and a third level V3 also configured to keep the sample-and-hold circuits off, wherein a difference in level between the levels V1 and V3 is greater than a difference in level between the levels V1 and V2; and operating the sample-and-hold circuits in succession by applying the first level V1 of the sampling signal to a first one of the sample-and-hold circuits to turn on the first one of the sample-and-hold circuits while applying the third level V3 of the sampling signal to sample-and-hold circuits other than the first one of the sample-and-hold circuits.

2. The method according to claim 1, wherein the providing step includes providing the levels V1, V2, and V3 of the sampling signal such that $(V2-V3)=(V1-V2)/(N-1)$.

3. The method according to claim 1, wherein the transition times for going from the second level V2 to the first level V1 and from the second level V2 to the third level V3 are identical, and in that the transition times for going from the first level V1 to the second level V2 and from the third level V3 to the second level V2 are identical.

4. The method according to claim 1, wherein the sample-and-hold circuits comprise transistors and the step of operating the sample-and-hold circuits in succession includes applying the sampling signal to a control electrode of each of the transistors.

5. The method according to claim 4, wherein the transistors are FET transistors.

6. The method according to claim 1, wherein the circuit comprising N data lines is a matrix display.

7. The method according to claim 6, wherein the matrix display is an LCD screen, an LED screen or an OLED screen.

8. The method according to claim 6, wherein the analogue signal is demultiplexed with the aid of P blocks of M sample-and-hold circuits, P and M being chosen to be positive integers and so that $N=P\times M$.

* * * * *